US007240744B1

(12) United States Patent
Kemick

(10) Patent No.: US 7,240,744 B1
(45) Date of Patent: Jul. 10, 2007

(54) ROTARY AND MUD-POWERED PERCUSSIVE DRILL BIT ASSEMBLY AND METHOD

(76) Inventor: Jerome Kemick, 1601 S. Sheperd #150, Houston, TX (US) 77019

( * ) Notice: Subject to any disclaimer, the term of this patent is extended or adjusted under 35 U.S.C. 154(b) by 0 days.

(21) Appl. No.: 11/427,184

(22) Filed: Jun. 28, 2006

(51) Int. Cl.
*E21B 1/28* (2006.01)

(52) U.S. Cl. ..... 175/106; 175/189; 175/296

(58) Field of Classification Search ..... 175/415, 175/417, 389, 106, 189, 296, 297, 317; 173/91, 173/206, 168
See application file for complete search history.

(56) References Cited

U.S. PATENT DOCUMENTS

| | | | | |
|---|---|---|---|---|
| 1,748,341 | A | | 2/1930 | Grant et al. |
| 2,072,470 | A | | 3/1937 | Thompson |
| 2,400,853 | A | | 5/1946 | Stilley |
| 2,673,716 | A | | 3/1954 | Avery |
| 3,807,512 | A | * | 4/1974 | Pogonowski et al. ..... 175/296 |
| 3,934,662 | A | | 1/1976 | Curington et al. |
| 3,941,196 | A | | 3/1976 | Curington et al. |
| 4,003,442 | A | | 1/1977 | Bassinger |
| 4,098,359 | A | | 7/1978 | Birdwell |
| 4,289,210 | A | | 9/1981 | Schoeffler |
| 4,353,426 | A | | 10/1982 | Ward |
| 4,478,296 | A | | 10/1984 | Richman, Jr. |
| 4,667,748 | A | | 5/1987 | Lavon |
| 4,745,981 | A | | 5/1988 | Buske |
| 4,919,221 | A | | 4/1990 | Pascale |
| 5,662,180 | A | | 9/1997 | Coffman et al. |
| 5,957,220 | A | | 9/1999 | Coffman et al. |
| 6,021,855 | A | | 2/2000 | Beccu et al. |
| 6,047,778 | A | | 4/2000 | Coffman et al. |
| 6,050,346 | A | | 4/2000 | Hipp |
| 6,062,322 | A | | 5/2000 | Beccu et al. |
| 6,131,672 | A | | 10/2000 | Beccu et al. |
| 6,209,666 | B1 | | 4/2001 | Beccu et al. |
| 6,371,221 | B1 | | 4/2002 | Harrigan et al. |
| 6,386,301 | B1 | | 5/2002 | Rear |
| 6,431,294 | B1 | | 8/2002 | Eddison et al. |
| 6,502,650 | B1 | | 1/2003 | Beccu |
| 6,533,052 | B2 | | 3/2003 | Wentworth et al. |
| 6,659,202 | B2 | | 12/2003 | Runquist et al. |

* cited by examiner

*Primary Examiner*—Lanna Mai
*Assistant Examiner*—Matthew J. Smith
(74) *Attorney, Agent, or Firm*—Gary L. Bush; Brett T. Cooke; Andrews Kurth LLP

(57) ABSTRACT

A method and apparatus for boring a hole in the earth including a drill bit assembly including a fluid-powered impact engine contained within a drillpipe sub between an ordinary drillpipe and a modified conventional rotary drill bit. The impact engine is powered by pressurized drilling fluid delivered via the drillpipe which acts on a piston to charge an energy accumulator, preferably in the form of a spring. Periodically, the pressurized drilling fluid in the impact engine is vented, allowing the energy accumulator to rapidly transfer its stored energy to an impact bit which is slidingly housed in a rotary bit to strike and fracture the formation.

17 Claims, 7 Drawing Sheets

ROTARY AND MUD-POWERED PERCUSSIVE DRILL BIT ASSEMBLY AND METHOD

BACKGROUND OF THE INVENTION

1. Field of the Invention

This invention relates generally to a method and apparatus for boring a hole in the earth and specifically to rotary and percussive drill bit assembly, which is preferably adapted for drilling wells for the hydrocarbon exploration and production industries but may be used for tunneling or similar applications.

2. Description of the Prior Art

The process of drilling a hole in the earth's crust involves abrasive wear of the formation, wherein earth is removed or displaced by hard particles or protuberances on a drill bit forced against or slid along the formation surface at the bore/formation interface. For a solid subjected to a uniaxial stress in the form of a point load (force), the observed behavior of the solid is usually perfect elastic deformation followed by irrecoverable distortion that may take the form of plastic flow or fracture. In other words, the abrasive wear generally occurs by two distinct mechanisms—abrasive wear by plastic deformation and abrasive wear by brittle fracture. Under some circumstances, either plastic deformation or brittle fracture may occur alone, but both often occur together. For both modes, the particle or protuberance must have a hardness greater than the hardness of the material to be abraded. The mechanisms of abrasive wear are treated by I. M. Hutchings in *Tribology: Friction and Wear of Engineering Materials*, CRC Press (1992).

In abrasive wear by plastic deformation, a hard particle or protuberance affixed to the drill bit is dragged across the surface of the formation under an indentation pressure. The ductile formation flows due to the action of the moving particle. Preferably, the flowing material is deflected, forming a chip which flows up the leading face of the particle in a process referred to as cutting. In cutting, all of the flowing material is removed from the substrate in a process analogous to cutting material with a single point tool in a machining process, such as turning on a lathe. However, abrasive wear by plastic deformation also occurs when the flowing material forms a raised prow of material in front of the leading edge of the particle. Some of the flowing material accumulates in the prow as the indenting particle is dragged across the substrate, while the remainder of the flowing material is ploughed under the particle. Eventually, a portion of the raised prow is lifted up the leading face of the particle and removed—a sequence referred to as wedge formation, which is repeated continuously as the particle moves across the substrate. The abrasive wear by plastic deformation removal mechanisms are exemplified by the use of early rotary drag-type drill bits (which are readily identified by their fish-tall-shaped blades) and present-day diamond-dressed (polycrystalline diamond compact (PDC) or natural diamond) bits.

Contrarily, in abrasive wear by brittle fracture, material removal predominantly occurs by brittle fracture of the formation with little contribution from plastic flow mechanisms. When a solid is subjected to a uniaxial stress in the form of a point load from a hard angular particle which indents the solid, intense shear and compression stresses are induced in the solid at the tip of the particle. At load values less than a critical value (which depends on the hardness and fracture toughness properties of the solid), the induced stresses are relieved by local plastic flow of the solid, densifying the immediate area surrounding the indentation. However, at load values above the critical value, the induced stresses cause a median vent crack to form perpendicular to the surface of the substrate from the bottom of the indention into the substrate. Increasing the point load deepens the crack. After a median vent crack is formed, removing the point load by moving the indenting particle away from the solid results in a relaxation of the deformed material around the point of indentation. Residual elastic stresses in turn cause the formation of one or more lateral vent cracks originating at the median vent crack and curving upwards to the surface of the solid. These lateral vent cracks destroy the integrity of the solid and lead directly to the removal of material from the solid. The abrasive wear by brittle fracture mechanisms are exemplified by the use of percussive early cable tool drilling techniques.

The modern tricone bit, a refinement over the Hughes cone bit introduced in 1908, marries the plastic deformation and the brittle fracture abrasive wear mechanisms in a single bit. As the drill bit axially rotates in the bore under a longitudinal compressive load, the roller cones are forced to revolve around their axes causing the protuberances to rapidly impact the formation (abrasive wear by brittle fracture), but cone offset and friction in the roller cones under load also cause the protuberances to be dragged slightly across the formation for shearing (abrasive wear by plastic deformation). For the protuberances to be effectively impacted against the formation surface, a large axial force must be imparted to tricone bits because the axial force is spread across a large number of indentation points on the roller cones which contact the formation at any given time.

Drilling methods, in which the entire rotary drill bit is periodically axially impacted against the formation during rotation in a manner to aid in fracture of the formation, have been proposed as another means of combining the two modes of abrasive wear to increase drilling rates. Most commonly, the entire cutting surface of the drill bit impacts against the formation due to hammering an anvil surface of the drill bit. The hammer that impacts the anvil surface of the bit can be located at the earth's surface, but it is more commonly located downhole in a drillpipe sub just above the drill bit. Such downhole hammers are usually pneumatically driven from a supply of compressed air at the earth's surface, but hydraulic downhole hammers are also known. Additionally, some down hole impact hammers include a transmission with cams or gears to transfer the rotational energy of the drill string into an axial impact force. Although such systems may use standard off-the-shelf drill bits, because the entire bit is impacted against the formation, the impact force is still spread across the large number of impact points resulting in only a fraction of the overall impact force acting at any given point in the formation.

Regardless of the abrasive mechanisms at play, it has been long recognized by those familiar with the art of drilling oil and gas wells that the most efficient drill assembly is that assembly which transfers maximum energy to the formation (rock face) to aid in the removal of the material of the well bore. Improvements that have advanced the drilling industry to its present day state include increased weight run on existing bit assemblies, increased rates of revolution through advances of down-hole motor assemblies, percussive means on the drill bit assembly, modifications of conventional rotating core bits, improvements to conventional button drag type and PDC drag type bits, and refinements of the mud systems employed. Such improvements are chronicled by the encompassing treatise, J. E. Brantly, *History of Oil Well Drilling*, Gulf Publishing Company (1971).

Despite such advancements, even today conditions exist in the drilling of deep, horizontal, or high pressured wells where the rates of penetration are very low and the associated costs are high. There is a need for a drill bit assembly that applies additional energy to the rock face (over what is being applied in the industry today) for an increased rate of penetration of the well bore and an accompanying reduction in the cost of the well bore.

3. Identification of Objects of the Invention

The primary object of the invention is to provide a method and apparatus that results in increased drilling rates.

Another object of the invention is to provide a drill bit assembly for which additional energy can be applied to the rock face (over what is being applied in the industry today) that results in a greater rate of penetration of the well bore and a concomitant reduction in well bore cost.

Another object of the invention is to provide a method and apparatus where, by increasing the energy level of the mud system to accommodate the piston mud engine of the invention, the drilling system is allowed to operate as before but with the added energy applied to the rock face that will aid in the penetration rate.

Another object of the invention is to provide a method and apparatus that can be used in any type of mud system including water, oil and polymer systems.

Another object of the invention is to provide a method and apparatus that can be used without modification in conventional rotary systems with ordinary drillpipe, downhole motor systems with conventional drillpipe or coiled tubing systems, top drive systems, vertical wells, deviated wells, and horizontal wells.

Another object of the invention is to provide a method and apparatus that includes a mud engine of the simplest type which uses the technology of the mud pumps that exist today.

Another object of the invention is to provide a method and apparatus that uses a metal spring as an energy accumulator that can be tailored to accommodate varying power directed to the impact bit.

Another object of the invention is to provide a method and apparatus where the mud engine components such as liners, pistons, ports, and valves use state of the art elastomers and hardened wear-resistant materials that typically allow for operation under normal conditions for continuous periods of up to 400 hours.

Another object of the invention is to provide a method and apparatus where the impact bit is of sufficient size and strength to drill and last for periods equaling or exceeding the expected life of the piston mud engine.

Another object of the invention is to provide a method and apparatus where the life of the accumulator metal spring exceeds the other components of the drill bit assembly.

Another object of the invention is to provide a method and apparatus that aids and improves control of directional drilling.

SUMMARY OF THE INVENTION

The objects identified above, as well as other features of the invention are incorporated in a method for concurrent rotary and percussive drilling of a hole in the earth and an apparatus for carrying out the method.

In a preferred embodiment, the method includes drilling a hole with a drill string including a generally conventional diamond drag-type or tricone drill bit that has a longitudinal passage formed therein for slideably housing at least a portion of an impact bit. The drill bit is connected to a drillpipe sub which houses a mud-powered impact engine for reciprocating the impact bit against the formation or for striking an anvil surface on the impact bit to aid in fracturing the formation. Power is provided to the impact engine using added or excess hydraulic power output of a mud system, by increasing its hydraulic power as needed, without disruption of the ordinary drilling setup.

In a preferred embodiment, the apparatus for carrying out the preferred method is a drill bit assembly including a drill bit with a central longitudinal passage formed therein, an impact bit which is at least partially slideably housed in the passage, and an impact engine housed in a sub and connected to the proximal end of the drill bit. The reciprocating impact engine operatively engages the impact bit causing it to strike against the formation through the passage. The impact engine preferably includes a hydraulic cylinder and a piston assembly slideably received in and dynamically sealed against the cylinder. The piston assembly defines a proximal lower pressure chamber and a distal higher pressure chamber in the cylinder. A spring is located in the proximal lower pressure chamber and is compressed by the piston assembly when drilling fluid is pumped under high pressure into the distal higher pressure chamber, forcing the piston in a proximal direction. When the spring is fully compressed, a fluid path is opened across the piston, equalizing the pressure differential and allowing the spring to rapidly and forcefully drive the piston assembly in a distal direction to act upon the impact bit, causing it to strike the formation.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
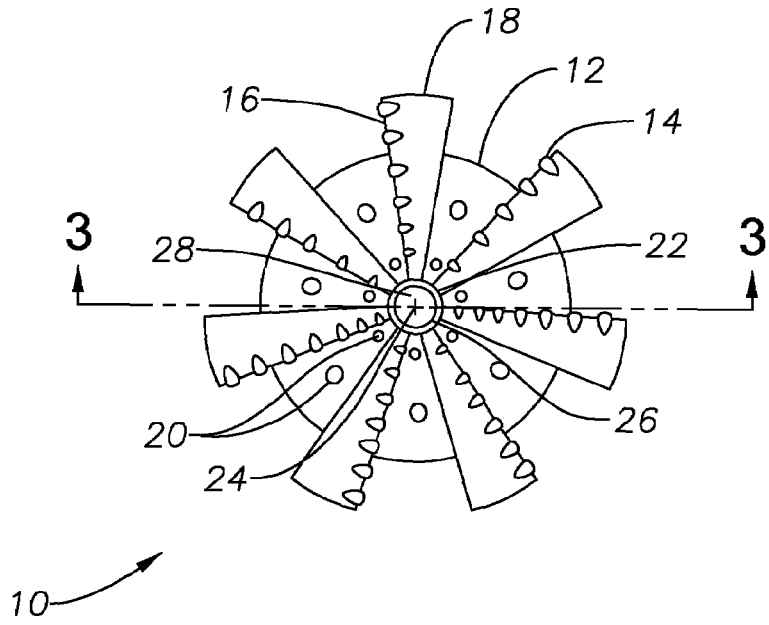
FIG. 1 is a transverse view of the working end of a drill bit assembly according to one embodiment of the invention, showing a conventional PDC drag-type rotary drill bit with a central longitudinal passage formed therein for slideably receiving an axial impact bit.

FIG. 1 illustrates the distal cutting end of a drill bit assembly 10 according to one embodiment of the invention. The drill bit assembly 10 preferably includes a drag-type drill bit 12 with hard cutters 14 pressed into the leading edges 16 of the flutes 18. The cutters 14 are preferably natural diamond or PDC, but other suitable materials may be used. Although seven straight flutes are shown, any suitable number of straight or curved flutes may be used. Drill bit 12 may include one or more nozzles 20 for jetting drilling fluid to aid in formation cutting, tool cooling, lubrication, and debris removal. The diameter of drill bit 12 is preferably suitable for boring a well of standard gauge.

Drill bit 12 has a longitudinal passage 22 formed therein for slideably housing an impact bit 26. The longitudinal passage 22 and impact bit 26 are preferably centered at drill bit centerline 24, but they may also be located off center. Impact bit 26 is reciprocated longitudinally so that its working point 28 periodically impacts the formation forcefully and at high velocity to cause brittle fracture abrasion. Due to the striking by impact bit 26, the integrity of a rock formation is generally compromised by formation of lateral and median vent cracks to a depth of and throughout a radius from the impact point of approximately ⅔ the indentation depth. With lateral vent cracks in the formation, cutting and removal of material from the formation is greatly enhanced. Impact bit 26 preferably has sufficient size, strength, and hardness to drill and last for periods equaling or exceeding the expected life of the remainder of the components within drill bit assembly 10. For example, in the normal drilling of a 9⅞ inch hole, a hardened sharpened impact bit 26 of 6 inches in length with a diameter of 2 to 3 inches is preferred.

Figure 2:
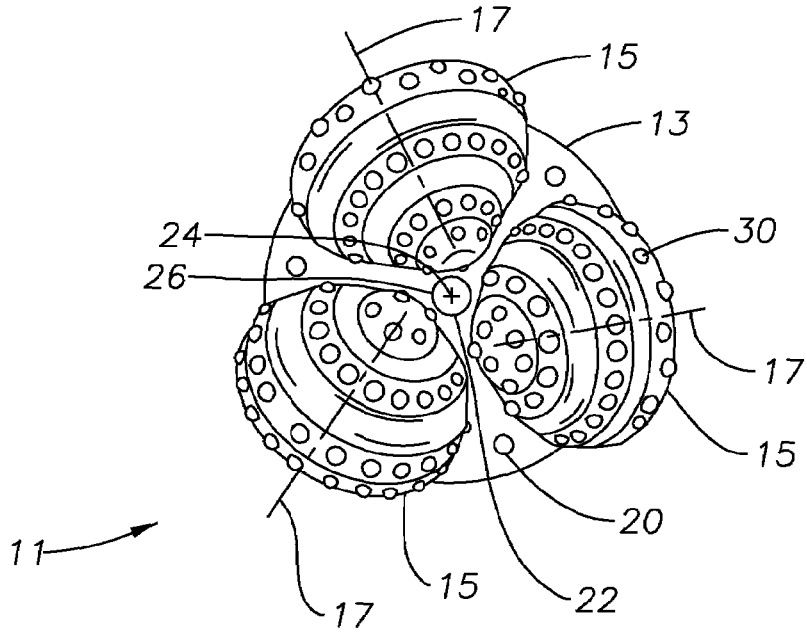
FIG. 2 is a transverse view of the working end of a drill bit assembly according to an alternate embodiment of the invention, showing a conventional offset tricone rotary drill bit with a central longitudinal passage formed therein for slideably receiving an axial impact bit.

FIG. 2 illustrates a drill bit assembly 11 according to an alternate embodiment of the invention. Drill bit assembly 11 preferably includes a tricone drill bit 13 having cones 15 with axes 17 significantly offset from the drill bit centerline 24 to accommodate the longitudinal passage 22 and impact bit 26. The cones 15 may have steel teeth or tungsten carbide inserts 30 as appropriate, although other cutters may be used. Drill bit 13 may also include one or more jetting nozzles 20 to aid in formation cutting, tool cooling, lubrication, and debris removal. The impact bit 26 is preferably similar to that described above with reference to FIG. 1. Although longitudinal passage 22 and impact bit 26 are illustrated in FIG. 2 as disposed at drill bit centerline 24, they may alternatively be located off-center. The remaining structure of drill bit assembly 11 of FIG. 2 is generally identical to that of drill bit assembly 10 of FIG. 1 as further described below.

Although a drill bit assembly 10 with a diamond bit 12 and a drill bit assembly 11 with a tricone bit 13 are described and illustrated herein, other assemblies characterized by a rotary bit which, includes a longitudinal passage 22 and an impact bit 26 housed therein, are within the scope of the invention, including cross-roller bits, two-cutter bits, four-cutter bits, Zublin cutters, disc bits, and fishtail drag bits. Preferably, the impact bit 26 is located in the center or near center of a conventional drill bit. The central location of the impact bit 26 aids and improves directional control during drilling.

Figure 3:
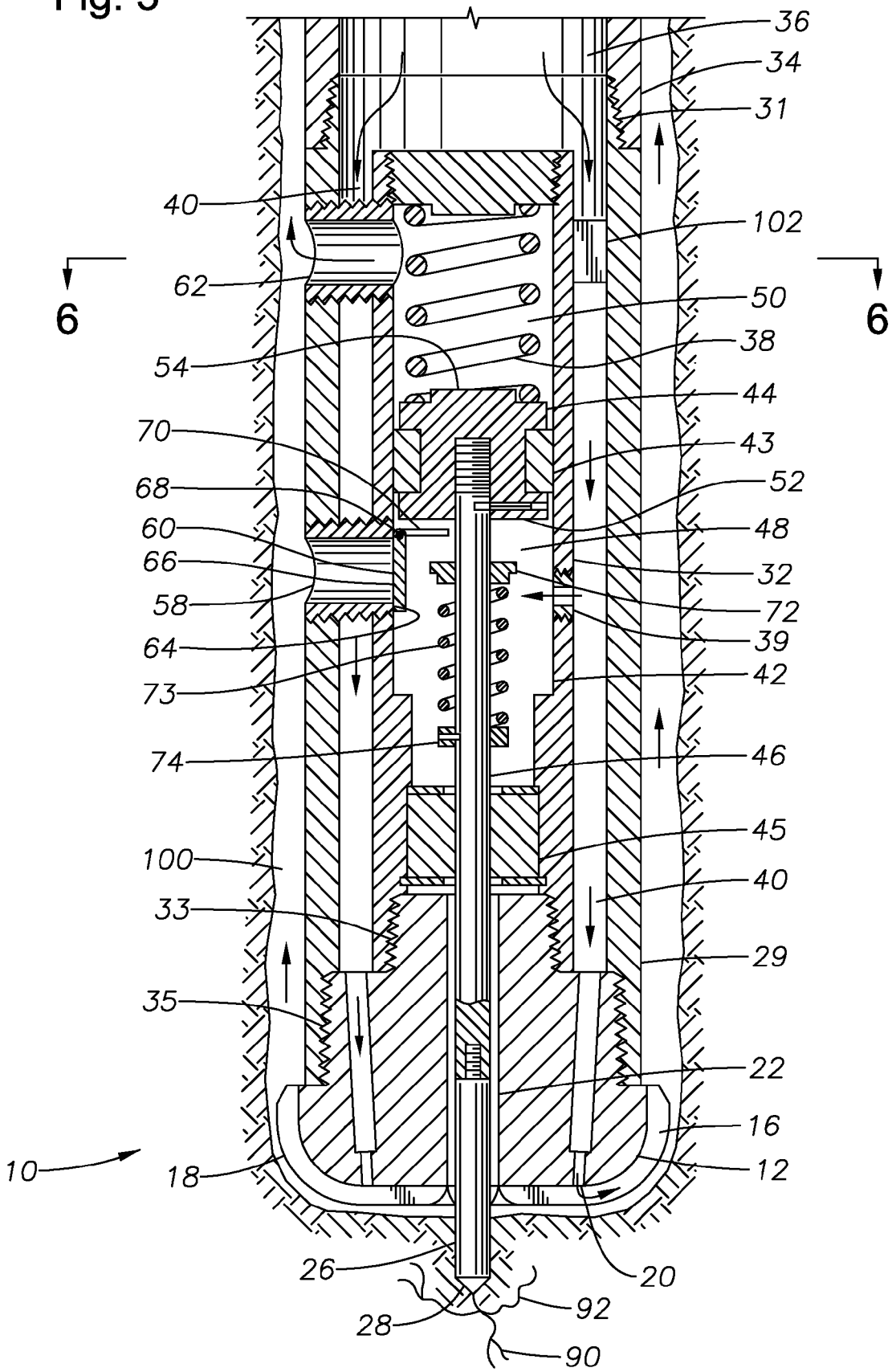
FIG. 3 is a longitudinal cross section taken along lines 3-3 of FIG. 1 showing a drill bit assembly according to a first embodiment of the invention which includes a drill bit coupled to a drillpipe sub coaxially housing an impact engine that is in turn connected to and actuates an impact bit, wherein the impact bit is in a fully discharged, distal position.

FIG. 3 is a longitudinal cross section of the drill bit assembly 10 of FIG. 1. Referring to FIG. 3, drill bit assembly 10 includes drill bit 12 which is connected to an impact engine 32, preferably using an internal thread 33. Drill bit 12 is also mounted to a drill pipe sub 29 using standard drillpipe or casing thread 35. Impact engine 32 is received in the drillpipe sub 29. The sub 29 has an ordinary drill pipe or casing thread 31 at its upper end for coupling to drillpipe 34. Thus, drill bit assembly 10 can be used without modification in conventional rotary systems with ordinary drillpipe, downhole motor systems with conventional drillpipe or coiled tubing systems, and top drive systems for drilling vertical wells, deviated wells, and horizontal wells.

The impact engine 32 converts power provided by drilling fluid via drillpipe 34 into axial reciprocating motion for hammering impact bit 26 into the formation. A drilling mud (or other drilling fluid) system is normally employed for rotary drilling of an oil and gas well to cool the bit assembly, control down-hole pressures, and remove drill bit cuttings. Reciprocating mud pumps (not illustrated) are generally used at the surface to circulate the drilling fluid down the hollow drillpipe, through nozzles at the drill bit, and back up the well bore outside of the drill string. Mud pumps commonly have two (duplex) or three (triplex) cylinders with replaceable liners and vary in hydraulic power. For example, the drilling of a 10,000 ft. Gulf Coast well may require a triplex mud pump of approximately 600 horsepower, whereas the mud pumps on an offshore rig typically have between 1300 and 1600 horsepower.

Mud pumps are preferably sized to provide a mud circulation rate sufficient to entrain bit cuttings and carry them to the surface. Annular flow velocities ranging between 100 ft./min. and 200 ft./min. are generally adequate, depending on the drilling rate. For a 9⅞ inch bore gage and a 5 inch drillpipe, 135 ft./min. annular flow velocity equates to a volumetric flow rate of about 400 gpm. At this flow rate, the pressure losses across the drillpipe, return annulus and surface mud system can be calculated to be about 1100 psi. Similarly, the pressure drop across the bit nozzles 20 of a typical drill bit 12 can be calculated to be about 1610 psi. Thus, the mud pump must provide a net discharge head of about 2710 psi at a flow rate of 400 gpm, requiring a hydraulic power of about 650 horsepower. Approximately 40 percent of the mud pump hydraulic power is used in overcoming frictional losses within the drillpipe, return annulus and surface mud system in the round trip circulation of the drilling fluid, and the remaining 60 percent of the power is available at the drill bit assembly 10 and is used for heat control of the drill bit 12 and for removal of cuttings through a jetting process at drill bit nozzles 20. For a more thorough discussion of the mud system fluid flow calculations used herein, the reader is directed to B. C. Craft, W. R. Holden and E. D. Graves, Jr., *Well Design: Drilling and Production*, Prentice-Hall, (1962).

The power available in the mud system at the drill bit assembly 10 can generally be increased or decreased by the mud pump operator. Increasing the power output of the mud pump to drive the impact engine 32 of drill bit assembly 10 allows the drilling system to operate in a conventional manner, but with the added energy applied to the rock face in the form of a concentrated impact by impact bit 26 that will aid in the penetration rate. Preferably, drill bit assembly 10 can be used in any type of mud system including water, oil and polymer systems.

Impact engine 32 receives pressurized drilling fluid from the interior 36 of conventional drillpipe 34 to actuate impact bit 26. In one embodiment, impact engine 32 is a hydraulic piston engine having a hydraulic cylinder 42 longitudinally connected to passage 22 and a piston 44 slidingly received in cylinder 42 which is connected to impact bit 26 via piston rod 46. More preferably still, as illustrated in FIG. 3, impact engine 32 is a single acting piston engine which uses a spring 38 as an energy accumulator to rapidly and forcefully drive the impact bit 26 in the outward distal direction. By using spring 38 as an energy accumulator, drill bit assembly 10 can be tailored to fit any desired horsepower directed thereto by the mud pump(s). However, other suitable arrangements, such as a double acting hydraulic piston/cylinder arrangement, may be used.

Referring to FIG. 3, piston 44 is dynamically sealed against the walls of cylinder 42 by piston seals 43. Likewise, piston rod 46 is dynamically sealed by packing 45. Piston 44, which includes a distal face 52 and a proximal face 54, defines a distal higher pressure chamber 48 and a proximal (surface side) lower pressure chamber 50. An annular conduit 40 between the interior of sub 29 and the exterior of the impact engine 32 fluidly couples the interior 36 of drillpipe 34 with the distal chamber 48 of cylinder 42 via inlet fitting 39. Inlet fitting 39 is used to regulate the flow of drilling fluid from drillpipe 34 to distal chamber 48. Inlet fitting 39 is preferably a replaceable orifice assembly with hardened surfaces to minimize fluid cutting or erosion of the orifice surfaces. Annular conduit 40 also preferably supplies pressurized drilling fluid to the jet nozzles 20 of drill bit 12. As pressurized drilling fluid is injected into distal chamber 48 from conduit 40, the drilling fluid exerts a force on the distal face 52 of piston 44. Spring 38, disposed in the proximal chamber 50 and seated against proximal face 54 of piston 44, opposes this force.

Impact engine 32 includes two high-capacity ports which fluidly couple cylinder 42 with the well bore annulus 100 outside the drill sub 29. The first high-capacity port 58 is located distally of piston 44 in the higher pressure chamber 48. Valve assembly 60 selectively opens and shuts distal high-capacity port 58. The second high-capacity port 62 is disposed proximally of piston 44 in proximal lower pressure chamber 50. Proximal high-capacity port 62 is preferably always open to allow free fluid communication between the well bore annulus 100 and the proximal chamber 50 of hydraulic cylinder 42.

Figure 4:
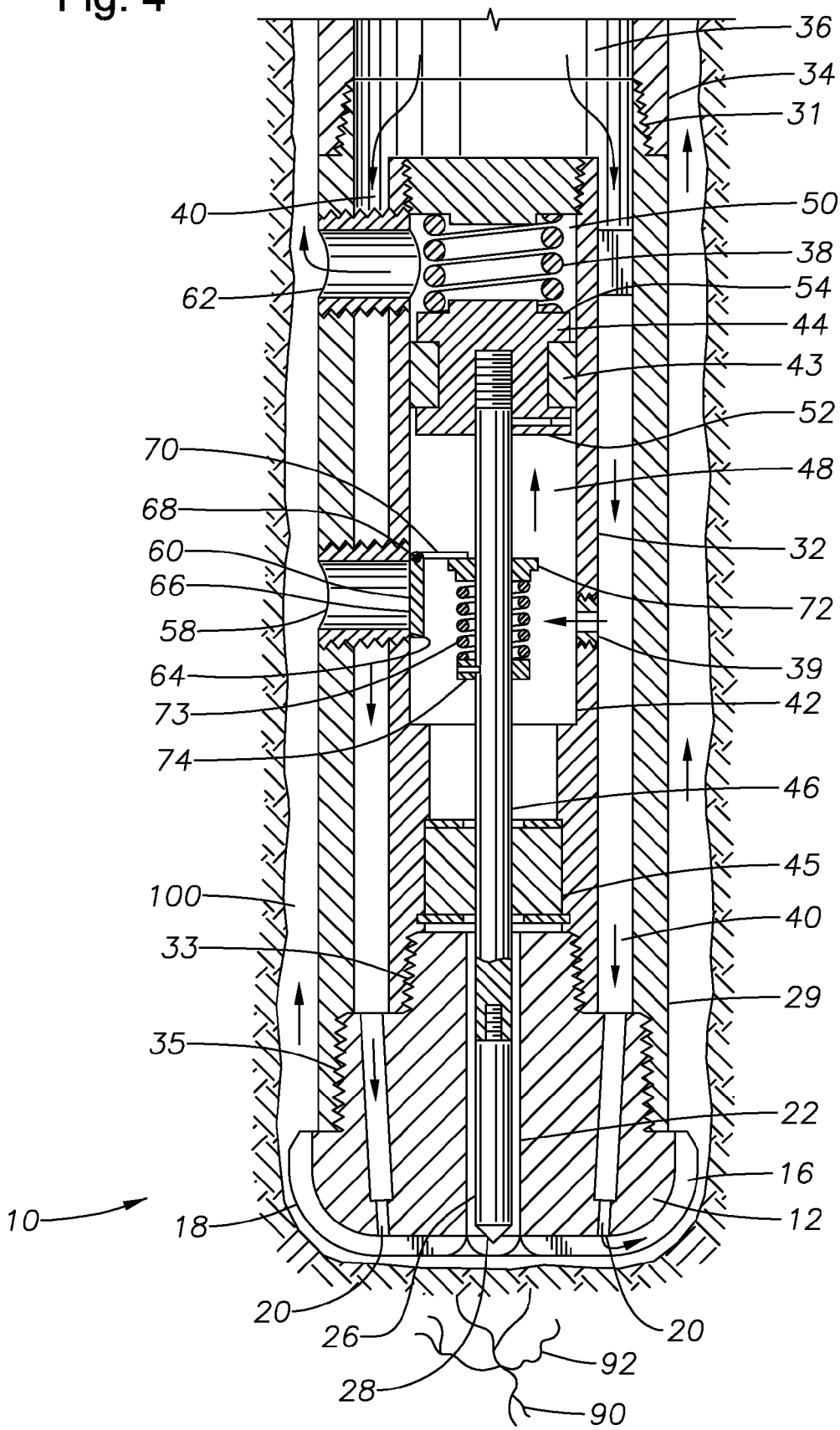
FIG. 4 is a longitudinal cross section view of the embodiment of FIG. 3 wherein the impact bit is in a fully charged, retracted proximal position just before the impact stroke is triggered.

The distal port valve 60 in FIG. 3 includes a valve seat 64, valve cover 66, hinge 68, and lever arm 70. The lever arm 70 is fixed in a generally orthogonal relationship to valve cover 66; both pivot together at hinge 68. Valve cover 66 seals against valve seat 64 when it is positioned as shown in FIGS. 3-4. Piston rod 46 includes a tripping collar 72 which engages lever arm 70 when piston 44 is at the point of full charge, i.e. when spring 38 is fully compressed. Tripping collar 72 forces lever arm 70 in a proximal direction and valve cover 66 away from valve seat 64, as illustrated in FIG. 5.

In a preferred embodiment, distal port valve 60 includes a hysteresis mechanism to create a difference between the valve opening and shutting set points. Ample hysteresis ensures the cylinder pressures completely equalize once the distal port valve 60 is tripped open to allow for a full impact stroke and to prevent valve chattering. The hysteresis mechanism shown in FIGS. 3-5 includes tripping collar 72 slideably captured on piston rod 46, tripping spring 73 captured by piston rod 46, and stationary collar 74 fixed to piston rod 46, for instance, by a pin. Tripping collar 72 is resiliently coupled to stationary collar 74 by tripping spring 73.

Alternatively, other suitable valve and trip device arrangements may be used. Slide and lift valves as used in the mud pump industry may be used in place of the flapper-style valve 60 of FIGS. 3-5. Also, battery operated electronic devices may be used to trip and/or actuate valve 60. Additionally, pressure trip and reset points, rather than positional trip and reset points, may be used. In an another embodiment, valve 60 is modeled after common safety valve design, where a predetermined or adjustable blowdown, i.e., the difference between opening and shutting pressures, may be obtained. Such a valve may have pilot circuitry and is preferably constructed of materials, such as forged AISI 4119 alloy steel, which can withstand the drilling mud environment for the expected life of the drill bit assembly 10. As safety valve design is well known in the art, it is not discussed further herein.

Figure 5:
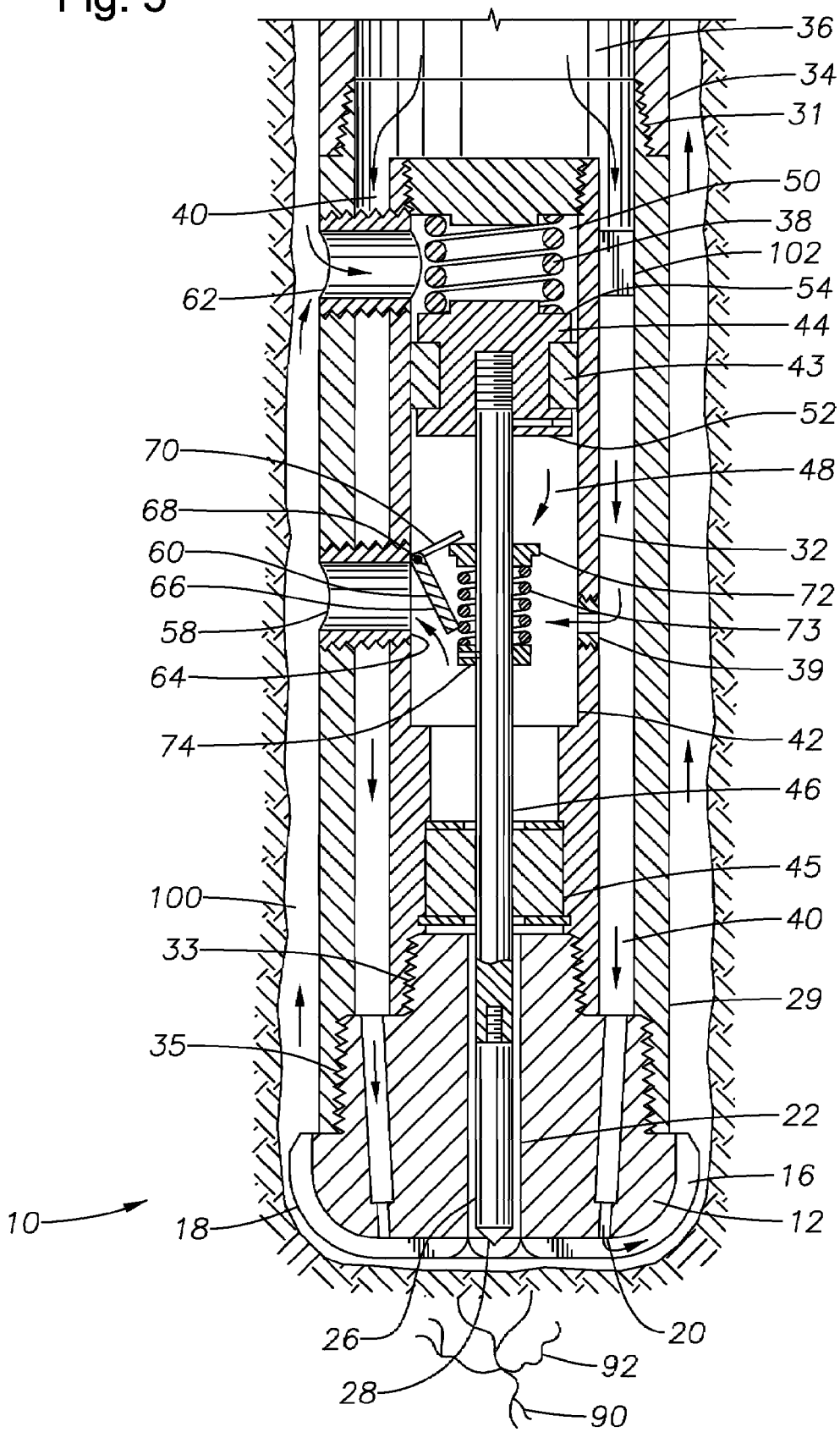
FIG. 5 is a longitudinal cross section view of the embodiment of FIG. 3 wherein the impact bit is in a fully charged, retracted proximal position immediately after the impact stroke is triggered.

FIGS. 3-5 illustrate the operation of drill bit assembly 10. Referring to FIG. 3, the impact bit 26 is shown at the fully discharged outer position. Spring 38 is in a relaxed or nearly relaxed position. Distal port valve 60 is in the shut position. Tripping spring 73 is fully relaxed, so that tripping collar 72 is located furthest away from stationary collar 74.

The mud pump (not shown) at the earth's surface provides pressurized drilling fluid, preferably drilling mud, to the drill bit assembly 10 via the interior 36 of drillpipe 34. The pressurized drilling fluid in drillpipe 34 enters annular conduit 40 and flows into distal chamber 48 of hydraulic cylinder 42 via inlet fitting 39 and into drill bit jetting nozzles 20. The jetting nozzles 20 form a flow restrictor that creates a backpressure within annular conduit 40. Inlet fitting 39 must be sized appropriately with respect to jets 20 to ensure sufficient fluid pressure is delivered both to distal chamber 48 and to the bore face through jetting nozzles 20 at the designed mud pump discharge pressures. If the jetting nozzles are too large, the may be insufficient mud pressure to effectively power the impact engine 32.

Referring to FIG. 4, as pressurized fluid is delivered to distal chamber 48, piston 44 is forced against and compresses spring 38. Spring 38 acts as an energy accumulator, storing potential energy for later transformation into motion of impact bit 26. Thus, the proximal motion of piston 44 (towards the surface) is referred to as the charging stroke. As piston 44 is moved proximally, fluid in the proximal lower pressure chamber 50 is displaced into the well bore annulus 100 via proximal high capacity port 62. The expelled fluid is combined with the recirculating drilling mud flowing up the well. As piston rod 46 moves proximally during the charge stroke, tripping collar 72 engages lever arm 70. The force exerted by lever arm 70 due to pressurized fluid in distal high pressure chamber 48 acting against valve cover 66 is greater than the force exerted by tripping collar 72 due to tripping spring 73 as it becomes compressed. Thus, tripping collar 72 does not open valve 60 but rather further compresses tripping spring 73 against stationary collar 74. FIG. 4 illustrates the drill bit assembly 10 with spring 38 at maximum compression just before distal port valve 60 is tripped to an open position later.

FIG. 5 illustrates the drill bit assembly 10 with spring 38 at maximum compression just as distal port valve 60 is tripped to an open position but before impact bit 26 has started its outward impact stroke due to the force of spring 38. As tripping spring 73 becomes fully compressed, further proximal motion of piston rod 46 causes the force exerted by tripping collar 72 to exceed the force of lever arm 70 due to mud pressure acting against valve cover 66. Tripping collar 72 forces valve 60 open. As valve 60 is tripped open, the higher pressure mud in distal chamber 48 is in fluid communication with the lower pressure drilling fluid in proximal chamber 50 via high capacity ports 60 and 62. The higher and lower pressures separated by piston 44 in hydraulic cylinder 42 equalize rapidly, and spring 38 forces piston 44, piston rod 46, and impact bit 26 distally outward with great force and at high velocity. Tripping collar 72 continues to hold valve 60 open as piston rod 46 travels distally until tripping spring 73 is fully relaxed, thus providing the necessary time for the pressures to equalize and allowing full travel of impact bit 26 during the impact stroke.

The resulting positions of piston 44, piston rod 46, impact bit 26 and valve 60 are shown again in FIG. 3. Due to the striking by the tip 28 of impact bit 26, the integrity of the rock formation is generally compromised by formation of a median vent crack 90 and one or more lateral vent cracks 92 to a depth of and throughout a radius from the impact point of approximately ⅔ the indentation depth. With lateral vent cracks 92 in the formation, cutting and removal of material from the formation is greatly enhanced.

The impact cycle illustrated by FIGS. 3-5 repeats continuously. The impact rate of drill bit assembly 10 is a function of spring 38 parameters (spring length and spring constant), inlet fitting 39 parameters (orifice size), the jetting nozzle dimensions, and the mud pump discharge pressure. The impact rate of drill bit assembly 10 may be varied by changing orifice size of the inlet fitting 39 or by varying mud pressure. However, other control methods may be used. For example, a centrifugal governor (not shown) that throttles inlet fitting 39 based on the rotational speed of the drillpipe 34 may be used. As governor design is well known in the art, it is not discussed further herein. Alternatively, inlet fitting 39 may be a battery-powered valve that is controlled either by the rotational speed of the drillpipe 34 or by downhole telemetry. Existing telemetry technology provides for sending control signals down smart drillpipe or by transmission in the drilling mud. The battery would preferably have ample energy to provide control for the life of the drill bit assembly 10. As downhole telemetry is well known in the art, it is not discussed further herein.

Because a mud system typically has abrasive inclusions such as 30 percent or more of quartz particles, impact engine 32 is preferably of the simplest type using the technology and materials of the mud pumps that exist today. For example, piston 44 is preferably manufactured from heat treated forged AISI 5140 alloy steel, and piston rod 46 is preferably made of forged alloy steel with a thermal refining treatment. Piston seals 43, piston rod packing 45, and any gaskets or o-rings are preferably made of rubber reinforced with fabric, urethane, or nitrile-butadiene rubber (NBR). Cylinder 42 is preferably manufactured with a chrome plated or high chrome iron inner surface with a bore hardness between 58 and 67 Rockwell C in a forged steel hull with a tensile strength exceeding 90,000 psi. Alternatively, cylinder 42 may be made of forged steel with a carburized inner surface having a hardness of 58-62 Rockwell C. Valve 60 and valve seat 64 are preferably a forged AISI 4119 alloy steel construction with deep carburized surfaces. Current mud pumps, which employ these state-of-the-art elastomers for seals and these hardened steel components for cylinders, pistons, ports, and valves, typically allow for operation under abrasive conditions for continuous periods of up to 400 hours. Thus, it is expected that impact engine 32 will operate for comparable periods of time. The remaining components of drill bit assembly 10 are preferably of sufficient size and strength to drill and last for periods equaling the expected life of the limiting impact engine 32. For example, in the normal drilling of a 9⅞ inch hole, a hardened sharpened impact bit 26 of 6 inches in length with a diameter of 2 to 3 inches should exceed a 400 hour life.

Figure 6:
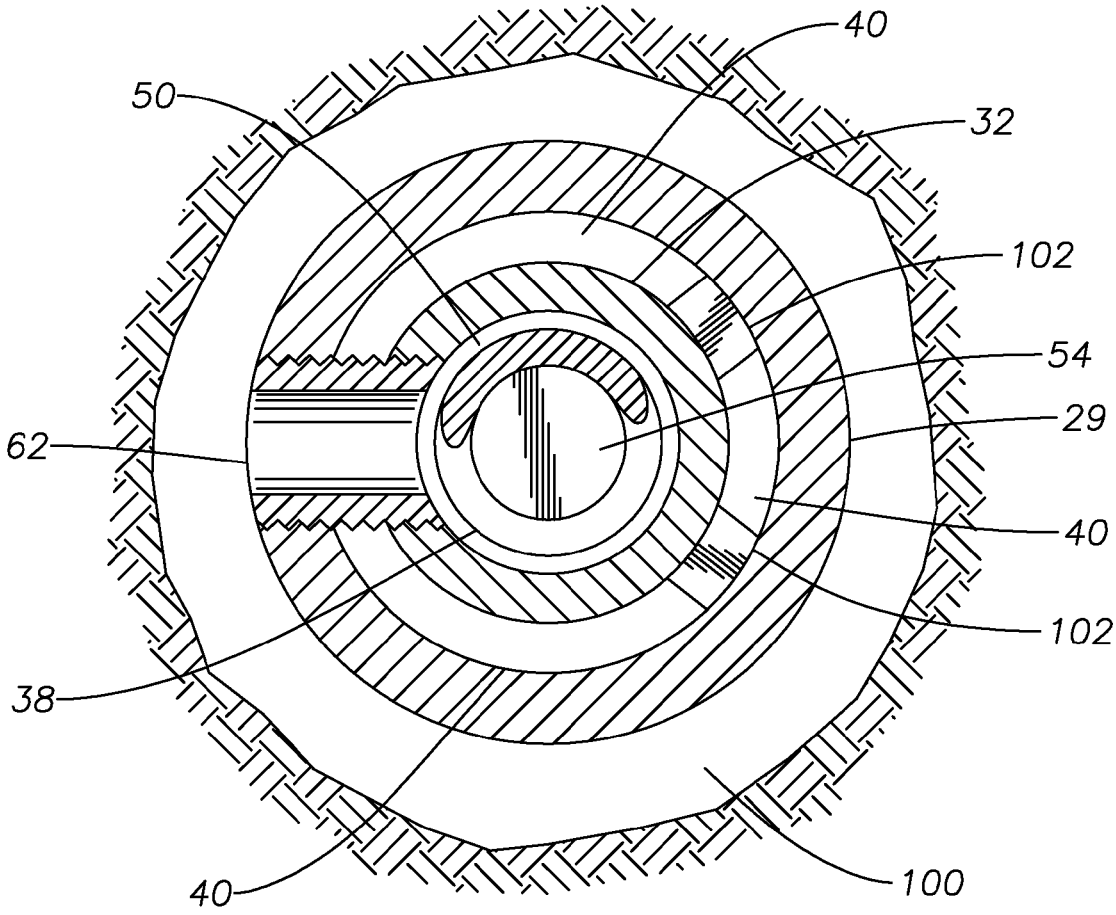
FIG. 6 is a transverse cross section of the embodiment of FIG. 3 taken along lines 6-6 of FIG. 3 showing the proximal mounting arrangement for the mud engine within the drillpipe sub and a high capacity fluid port.

FIG. 6 is a transverse cross section taken along lines 6-6 of FIG. 3. Impact engine 32 is preferably coaxially disposed within sub 29, defining annular conduit 40. However, the impact engine may be transversely positioned off center or be angularly offset within drill sub 29. A number of resilient spacers 102 preferably keep impact engine 32 properly positioned within sub 29. The proximal high-capacity fluid port 62 is preferably formed by a threaded sleeve which bridges the annular conduit 40 between impact engine 32 and sub 29. The distal high-capacity fluid port 58 (FIGS. 3-5) is likewise preferably formed.

Figure 7:
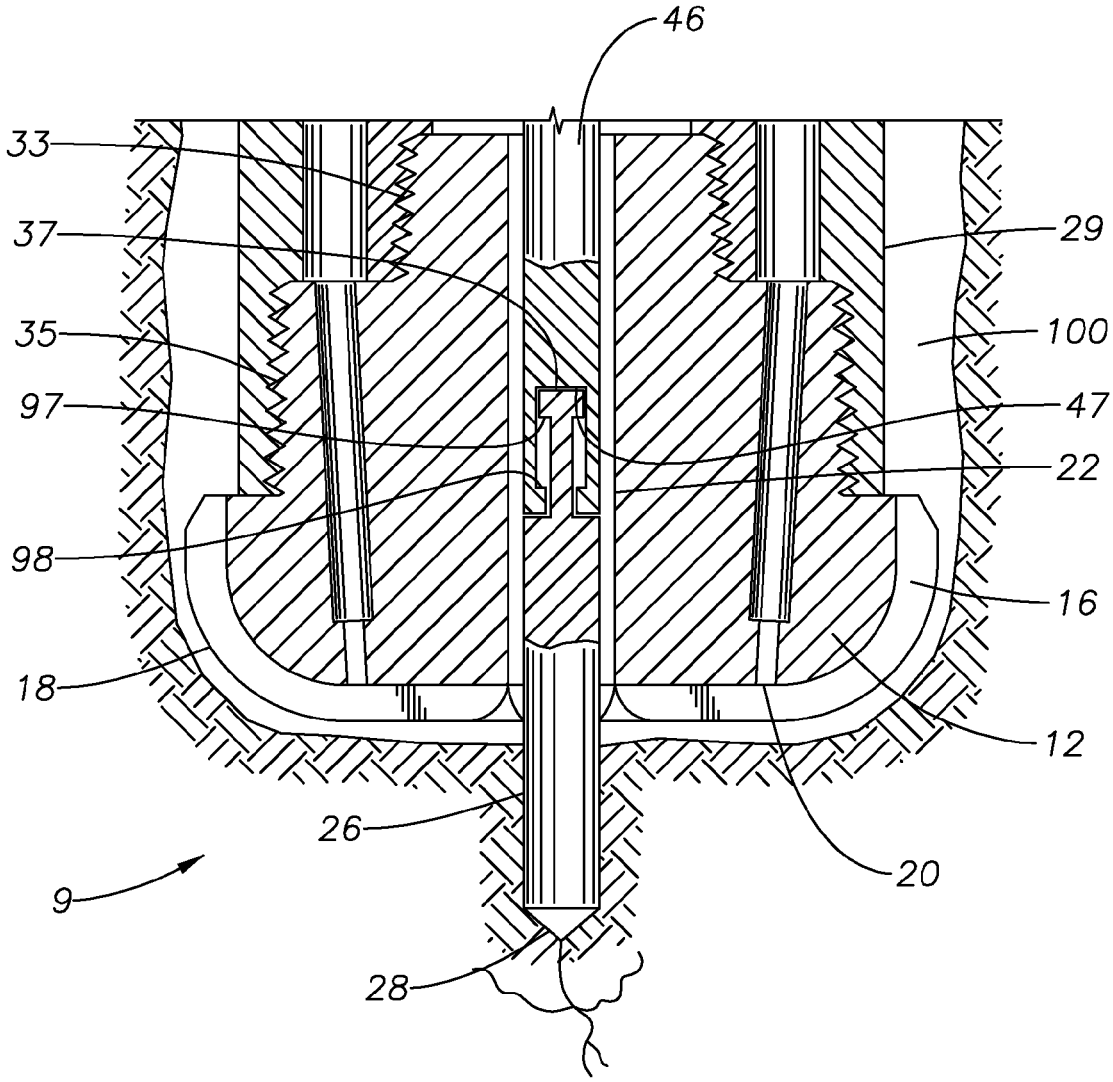
FIG. 7 is a longitudinal cross section view of an impact bit assembly according to an alternate embodiment of the invention showing non-rigid attachment of the impact bit to the impact engine during the impact stroke.
Figure 8:
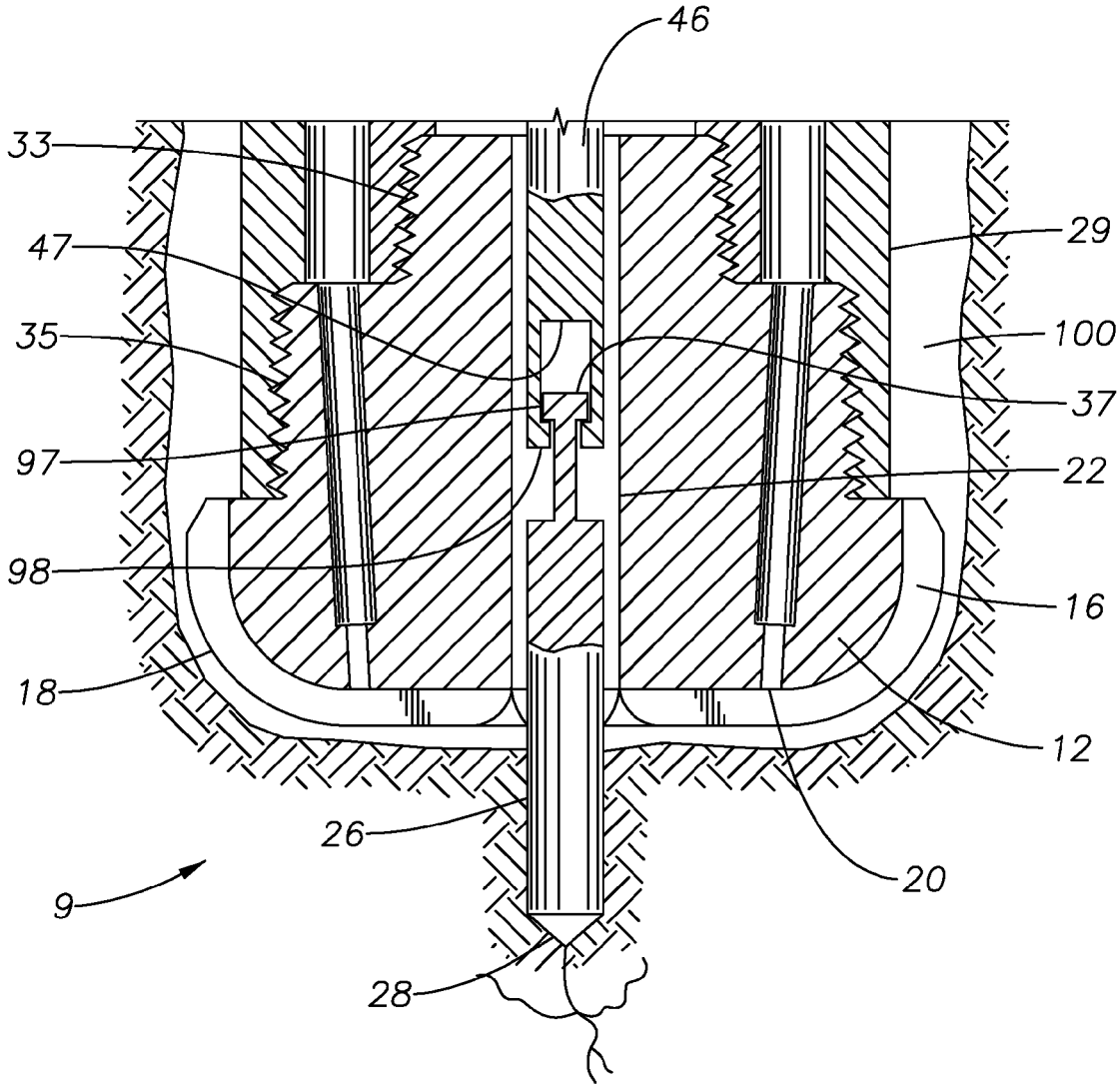
FIG. 8 is a longitudinal cross section view of the impact bit assembly of FIG. 7 during the charging stroke.

FIGS. 7 and 8 illustrate an alternate embodiment—drill bit assembly 9. Drill bit assembly 9 is nearly identical to drill bit assembly 10 as shown in FIGS. 3-5, except that impact bit 26 is not made fast to piston rod 46. The distal end 47 of piston rod 46 acts as a hammer which strikes the proximal anvil surface 37 of impact bit 26. Impact bit 26 freely slides within passage 22, but it contains a capturing stop 97 that engages a distal shoulder 98 of piston rod 46 to keep impact bit 26 non-rigidly attached to piston rod 46. The operation of drill bit assembly 9 of FIG. 6 is generally the same as described above with regards to drill bit assembly 10 of FIGS. 3-5, respectively. During the impact stroke, the piston rod moves distally with respect to impact bit until, as illustrated in FIG. 7, as the hammer surface 47 of piston rod 46 strikes anvil surface 37 of impact bit 26. The impact momentum is transferred to impact bit tip 28. During the charging stroke, illustrated in FIG. 8, as piston rod 46 moves in the proximal direction, it slides relative to impact bit 26 until the shoulder 98 engages stop 97 for carrying the impact bit for the remainder of travel. Although the drilling jars used in cable tool systems are similar in design, this embodiment is used to transfer the accumulated energy of the impact engine to a selected smaller volume of the earth by decreasing the travel stroke of the impact bit in relation to the travel stroke of the impact engine.

The Abstract of the disclosure is written solely for providing the United States Patent and Trademark Office and the public at large with a means to determine quickly from a cursory inspection the nature and gist of the technical disclosure, and it represents solely a preferred embodiment and is not indicative of the nature of the invention as a whole.

While some embodiments of the invention have been illustrated in detail, the invention is not limited to the embodiments shown. Modifications and adaptations of the above embodiments may occur to those skilled in the art. Such modifications and adaptations are in the spirit and scope of the invention as set forth herein:

What is claimed is:

1. A drill bit assembly (10) comprising:

a rotary drill bit (12) having a proximal end adapted for connection to a drillpipe (34) that supplies drilling mud or foam and a distal end designed and arranged to bore a hole in the earth due to rotation about a longitudinal axis (24) thereof, said drill bit characterized by having a longitudinal passage (22) formed therein;

a single impact bit (26) having at least a portion thereof slideably housed in said passage and having a distal end designed and arranged to impact the earth; and a hydraulically actuated impact engine (32) disposed within and coupled to said drillpipe and having a reciprocating member (44, 46) coupled to said impact bit, said impact engine fluidly coupled to said drillpipe for receiving said drilling mud or foam which acts on said reciprocating member;

wherein said impact engine includes, a hydraulic cylinder (42) formed longitudinally therein and disposed tandem to and in communication with said passage, a piston assembly (44, 46) slideably received within and generally dynamically sealed against said cylinder and defining a first chamber (48) and a second chamber (50) therein, said piston assembly defining said reciprocating member, an energy accumulator (38) operatively coupled to said piston assembly, a conduit (40) fluidly coupling a point at said proximal end of said impact engine to said cylinder, and an isolatable fluid path (58, 62) disposed between said first chamber and said second chamber;

whereby said impact engine is designed and arranged to cause said impact bit to strike the earth and said drilling mud or foam provides energy to said energy accumulator, which is subsequently converted to longitudinal motion of said piston assembly for causing said impact bit to strike the earth.

2. The drill bit assembly of claim 1 wherein:

said passage is disposed generally coaxially to said longitudinal axis; and said cylinder is disposed generally coaxially to said longitudinal axis.

3. The drill bit assembly of claim 1 wherein:

said energy accumulator is a spring.

4. The drill bit assembly of claim 1 wherein:

said isolatable fluid path is defined by a first port (58) fluidly coupling said first chamber and the exterior of said impact engine, a valve (60) designed and arranged to selectively isolate said first port, and a second port (62) fluidly coupling said second chamber to the exterior of said impact engine.

5. The drill bit assembly of claim 4 further comprising:

a trip mechanism (72) for opening said first valve.

6. The drill bit assembly of claim 1 wherein:

said reciprocating member is fixed to said impact bit.

7. The drill bit assembly of claim 1 wherein:

said reciprocating member has a hammer surface (47) which strikes an anvil surface (37) of said impact bit.

8. In a drill bit assembly including a rotary drill bit (12) having a distal end designed and arranged to bore a hole in the earth and a proximal end for attachment to a drillpipe (34) that supplies drilling mud or foam to said drill bit, the improvement comprising:

a generally longitudinal passage (22) formed in said drill bit;

an impact bit (26) having at least a portion thereof slideably housed in said passage;

an impact engine (32) coupled to said drill bit, said impact engine including a hydraulic cylinder (42) fluidly coupled to an interior (36) of said drillpipe for receiving said drilling mud or foam, a piston (44) slideably received in said cylinder, and an energy accumulator (38) coupled to said piston, said piston coupled to said impact bit, said piston defining a first chamber (48) and a second chamber (50) within said hydraulic cylinder, the impact engine further comprising an isolatable fluid path (58, 62) disposed between said first chamber and said second chamber;

whereby said drilling mud or foam provides energy to said energy accumulator, which is subsequently converted to longitudinal motion of said piston for causing said impact bit to strike the earth.

9. The drill bit assembly of claim 8 wherein:

said energy accumulator is a spring.

10. The drill bit assembly of claim 8 further comprising:

a first port (58) fluidly coupling said first chamber and the exterior of said drillpipe;

a valve (60) designed and arranged to selectively isolate said first port;

a second port (62) fluidly coupling said second chamber to the exterior of said drillpipe; and a trip mechanism (72) for opening said first valve; whereby said first port, said second port and said first valve define said isolatable fluid path.

11. The drill bit assembly of claim 8 further comprising:

a drillpipe sub (29) coupled between said drill bit and said drillpipe, said drillpipe sub housing said impact engine.

12. A method for drilling a hole in the earth comprising the steps of:

forming a drill string having a rotary drill bit (12) characterized by having a longitudinal passage formed therein for slideably housing an impact bit (26) therein, a drilling mud or foam actuated impact engine (32) connected to said drill bit and to said impact bit, and a drillpipe (34) connected to said impact engine;

rotating said drill string about a longitudinal axis (24) against the earth under a weight;

supplying said drilling mud or foam by said drillpipe;

powering said impact engine with said drilling mud or foam to reciprocate a piston (44) within a hydraulic cylinder of said impact engine;

moving said piston (44) in a first direction by creating a pressure difference across said piston due to said circulating drilling mud or foam;

compressing a spring (38) by said piston;

equalizing said pressure difference across said piston by opening a fluid path (58, 62) around said piston;

allowing said compressed spring to move said piston in a second direction;

reciprocating said impact bit by said piston; and striking the earth by said impact bit through said passage.

13. The method of claim 12 further comprising the step of:

striking an anvil surface (37) of said impact bit by a hammering surface (47) of said reciprocating member.

14. The method of claim 12 further comprising the step of:

reciprocating said impact bit by fixing said impact bit to said reciprocating member.

15. The method of claim 12 further comprising the step of:

providing a hydraulic power to said impact engine by a hydraulic fluid pump which circulates said drilling mud or foam.

16. The method of claim 15 further comprising the step of:

accumulating potential energy in the form of a compressed spring (38) from energy transferred by said circulating drilling mud or foam.

17. An impact engine assembly (32, 26) for connection to an impact bit (26) comprising:

a drillpipe sub having a proximal end adapted for removable connection to a hollow drillpipe (34) and a distal end designed and arranged for removable connection to a rotary drill bit (12) which slidingly accommodates said impact bit therein;

a hydraulic cylinder disposed within said drillpipe sub;

a piston slideably disposed in said cylinder for coupling to said impact bit, said piston defining a first region of said cylinder which is hydraulically coupled to an interior of said hollow drillpipe and a second region which is hydraulically coupled to a region external to said drillpipe;

a spring coupled to said piston; and a triggering mechanism whereby drilling mud or foam from said hollow drillpipe pressurizes said first region, moving said piston in a first direction and compressing said spring, whereby said triggering mechanism vents said first region to said second region, allowing said spring to relax, moving said piston in a second direction opposite to said first direction.

* * * * *